US007151449B2

(12) United States Patent
Meijer

(10) Patent No.: US 7,151,449 B2
(45) Date of Patent: Dec. 19, 2006

(54) AUTOMATIC LOCKSET TAMPER DETECTION DEVICE AND METHOD

(75) Inventor: Robert S. Meijer, San Diego, CA (US)

(73) Assignee: Major Monitors, San Diego, CA (US)

( * ) Notice: Subject to any disclaimer, the term of this patent is extended or adjusted under 35 U.S.C. 154(b) by 308 days.

(21) Appl. No.: 10/604,639

(22) Filed: Aug. 6, 2003

(65) Prior Publication Data

US 2005/0030178 A1 Feb. 10, 2005

Related U.S. Application Data

(60) Provisional application No. 60/319,451, filed on Aug. 6, 2002.

(51) Int. Cl.
*E05B 45/06* (2006.01)

(52) U.S. Cl. ..... 340/542; 200/61.64

(58) Field of Classification Search ..... 340/542, 340/541, 543, 545.1; 200/61.64, 61.66, 61.68
See application file for complete search history.

(56) References Cited

U.S. PATENT DOCUMENTS 4,360,803 A * 11/1982 Heiland ..... 340/542
4,465,997 A * 8/1984 Hines ..... 340/542
5,062,670 A * 11/1991 Grossman ..... 292/137
5,266,923 A * 11/1993 Tseng ..... 340/542
5,680,094 A * 10/1997 Guim et al. ..... 340/332
5,757,269 A * 5/1998 Roth et al. ..... 340/542
5,825,288 A * 10/1998 Wojdan ..... 340/542
6,020,816 A * 2/2000 Agozzino ..... 340/542
6,225,903 B1 * 5/2001 Soloway et al. ..... 340/542

* cited by examiner

*Primary Examiner*—John Tweel, Jr.

(57) ABSTRACT

A device for detecting tampering with standard mechanical locksets has a pair of electrical contacts placed within the recess that receive lock's bolt and a third conductor positioned to run vertically along the door frame. A control box sends a low-level radio frequency (RF) signal to the first contact that in turn energizes the entire lockset when the bolt is in its extended position. The second contact returns RF energy to the control box to signal that the bolt is in its extended or locked position. Measured changes in capacitance serve to automatically enable tamper detection when the lockset is in its locked position; further, to automatically signal an alarm when the locked lockset is tampered with, to automatically disable tamper detection when the lockset is in its unlocked position and to define one or more protected areas whose status may then be signaled through conventional multi-zone security systems.

11 Claims, 3 Drawing Sheets

AUTOMATIC LOCKSET TAMPER DETECTION DEVICE AND METHOD

CROSS REFERENCE TO RELATED APPLICATIONS

This application is a continuation of my Provisional Patent Application No. 60/319,451 filed Aug. 6, 2002

BACKGROUND OF INVENTION

Home security systems are notoriously subject to both false alarms and missed alarms. Over 90% of home security alarms are reported to be false alarms. Missed alarms, from failure to turn the security system on, are estimated to occur 30% to 50% of the time. The principal failing of these systems is in the extra time and care required to disable security systems before entry and to enable them upon leaving.

Law provides more severe penalties for "Breaking and Entering" than for apparently non-forced entry. Further, forced entry is usually noisy and may result in unwanted attention. Would-be intruders can therefore be expected to first try passkeys, lock picks or like tests of lock integrity before generating evidence of forcible entry.

The acts of locking a door behind on leaving and unlocking it upon returning are relatively automatic behaviors, much easier to maintain than additional and often complex arming and disarming sequences required with current home security systems. There is a need, therefore, for a security system that automatically arms upon locking a conventional keyed door and automatically disarms upon unlocking that door. Further, there is a need to reliably detect and alarm upon lockset tampering and similar indicators of attempted illegal entry. These needs would ideally be filled by a device able to operate with existing mechanical locksets and with all alarm operations fully controlled by normal actuations of the existing lockset.

SUMMARY OF INVENTION

A preferred embodiment of the device for detecting tampering with standard mechanical locksets comprises; a pair of electrical contacts placed within the recess that receives lock's bolt, a ribbon cable with three conductors, and a control box. The contacts provide an electrical connection to the bolt and hence the entire lockset when the bolt is in its extended or locked position. The two contacts are each connected to individual conductors in a ribbon cable that also carries a third conductor, positioned to run vertically along the door frame below the bolt receptacle. The third vertical conductor approaches the other two at approximately the height of the bolt, and then all three make a short horizontal run to a control box secured to the interior door frame or wall.

The two contacts within the bolt recess operate cooperatively to signal whether the bolt is in its extended and locked position or in its retracted and open position. The active, or energized, of the two contacts also serves to convey a low-level RF signal to the entire lockset including all externally accessible mounting and operational features. When a person standing by the door touches any part of the energized lockset, the capacitance measured between the lockset and the vertical wire is significantly increased.

Logic circuitry within the control box is used to discriminate between normal operation of the lockset and operations indicative of tampering. Representative tampering detected includes sequentially testing multiple keys, use of lockpicks, and application of disassembly tools.

The novel features of this invention, as well as the invention itself, both as to its structure and operation, will be best understood from the accompanying drawings, taken in conjunction with the accompanying description in which similar reference characters refer to similar parts.

DETAILED DESCRIPTION

Figure 1:
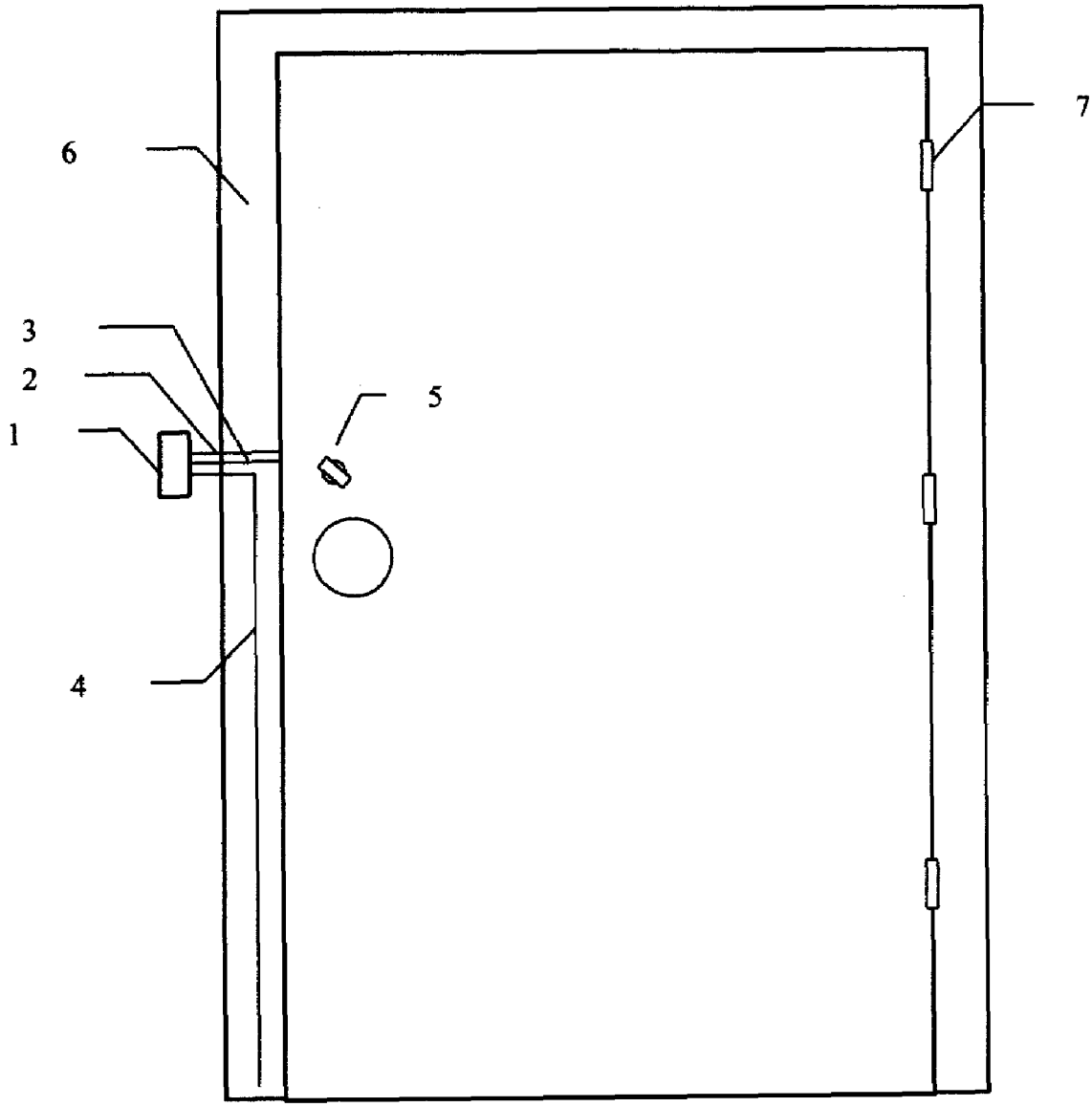
FIG. 1 is a perspective view of the automatic lockset tamper detection device in its intended environment.

Referring now to FIG. 1, there is shown a door with lockset. The door is fitted into door frame 6 to which it is secured by hinges 7. To lock or unlock the door from the inside, bolt actuator 5 is rotated in one direction so as to extend the bolt and thereby lock the door, or in the opposite direction to retract the bolt and unlock the door. Generally this operation is accomplished by a key on the outside or a rotatable knob on the inside. Adapted to the door and frame are three conductors, 2, 3, and 4, shown as they are positioned within a ribbon cable and against the door frame.

Figure 2:
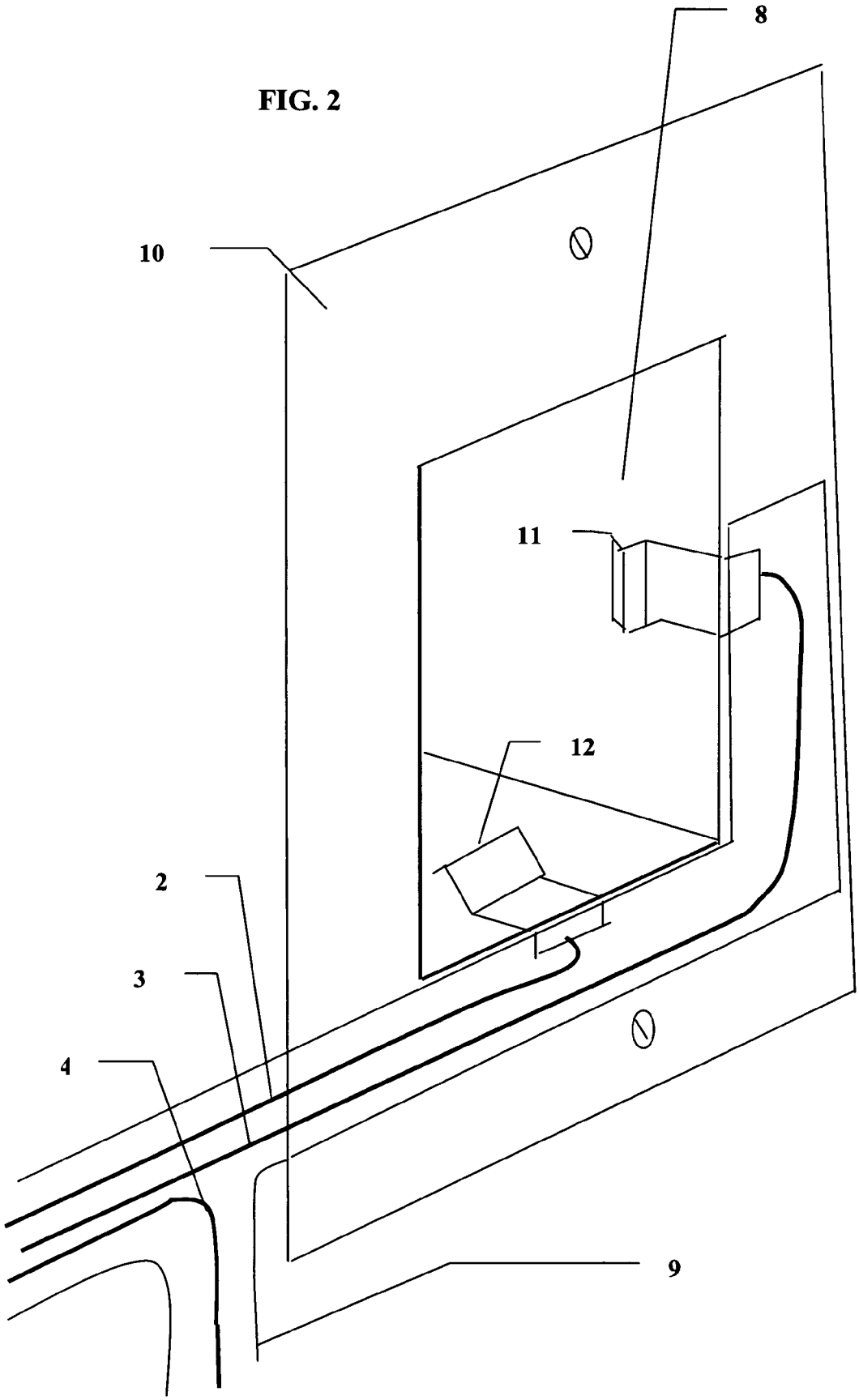
FIG. 2 is a perspective view of the bolt contacts and their connection to the ribbon cable.

FIG. 2 shows bolt receptacle 8, latch plate 9, and two leaf-spring contacts 11 and 12. The leaf-spring contacts are secured within the bolt receptacle so as to ensure that they are wiped by the metal bolt as it extends or retracts. The material, position, and shape of these contacts ensures reliable electrical contact with the bolt and provides sufficient deflection so as to not interfere with the bolt's normal motions. The depths to which the contacts are placed within the bolt receptacle ensures that both contacts engage a fully extended bolt, that neither engages a fully retracted bolt and that the intended sequence of contact engagement is maintained.

Both leaf-springs, the adhesive to secure them in place, the conductors attached to the leaf-springs, and all required insulation comprise an integral ribbon cable assembly 9. Orientation of the cable assembly is conveniently established by positioning the cable corner between the two contacts to coincide with the corner of the bolt recess as shown in FIG. 2. This orientation allows successful operation irrespective of bolt size. The other end of the ribbon cable connects to the control box by means of a conventional ribbon cable connector.

Figure 3:
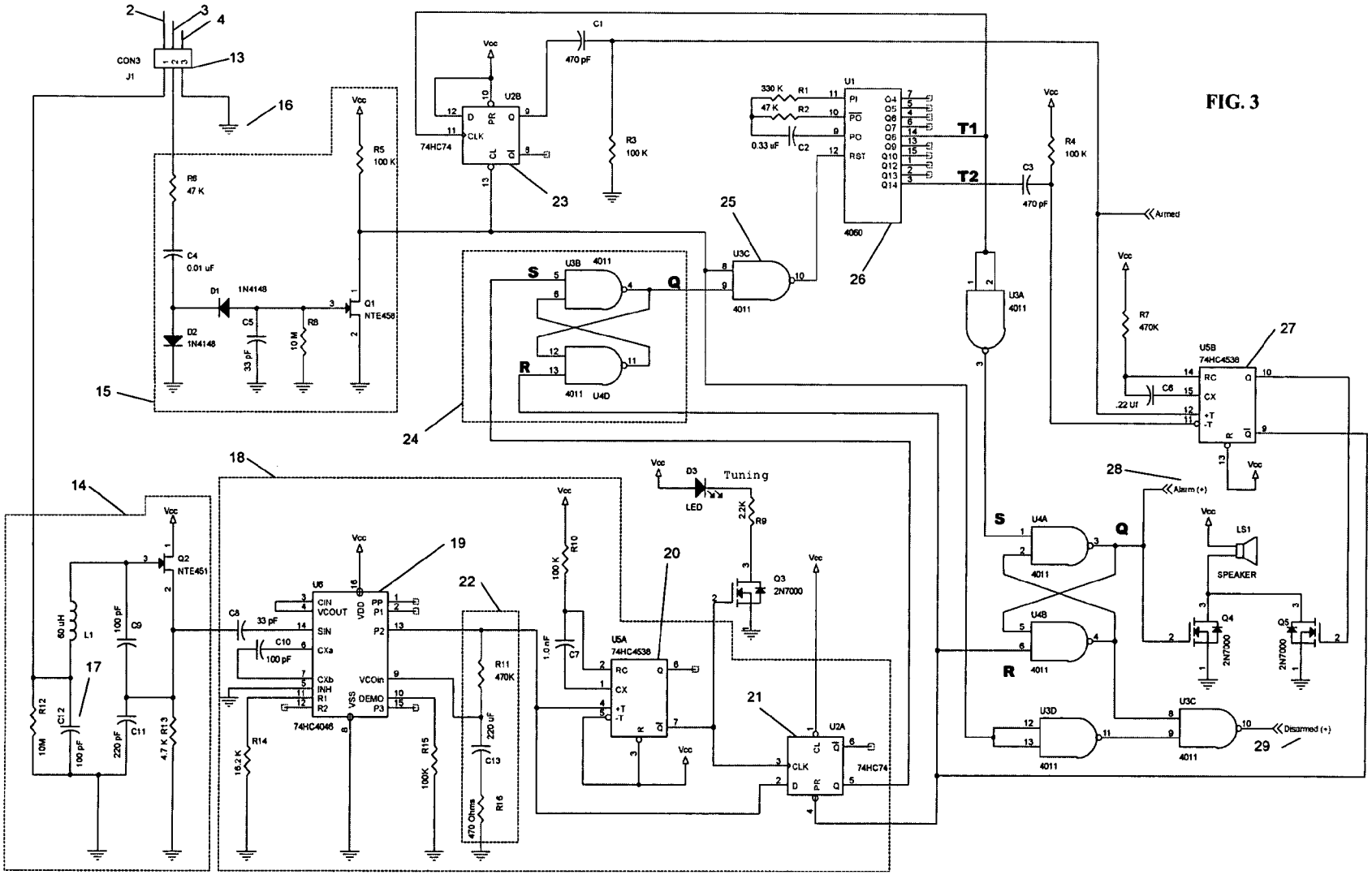
FIG. 3 is a schematic diagram of the control box circuitry.

FIG. 3 is a schematic of control box circuitry. Ribbon cable conductors 2, 3 and 4, described above,engage with control box circuitry via connector 13. Conductor 2 is connected to the tank circuit of Clap oscillator 14, conductor 3 is connected to RF detector circuit 15 and conductor 4 is connected to circuit ground or common 16. External capacitance, measured between conductor 2 and conductor 4, is effectively additive to tuning capacitor 17 and serves to increase tank circuit capacitance. This external capacitance has a small fixed component, attributable to external wiring, and a large variable component, attributable to human contact with the external portions of lockset 5. Such contact with the closed or locked lockset extends the energized area to include the person touching the lockset and thereby significantly increases the capacitance measured between conductor 2 and conductor 4. A substantial portion of this capacitance increase is attributable to the relatively large capacitance developed between the person outside the door and the vertical portion of conductor 4 on the interior side of the door frame. The net effect of this increased capacitance is reduction in the frequency of oscillation upon human contact with the lockset whether that contact is direct, through keys, through tools, and/or through gloves.

Detection of change in oscillation frequency, indicative of human contact is obtained through frequency change detector 18 comprised of phase locked loop (PLL) 19, monostable multivibrator 20 and D-type flip flop 21. Phase locked loop 19 is configured tomaintain phase lock with oscillator 14 over frequency changes associated with normal circuit noise, component drift, and environmental changes. Loop filter 22 is configured to control how quickly the phase locked loop can react to changes in the frequency of oscillation of oscillator 14. Slow changes in oscillation frequency are tracked by means of pulses from the PLL's phase detector, approximately one per oscillator cycle, that continuously provide the feedback required to maintain phase lock between randomly drifting oscillator 14 and the PLL's voltage controlled oscillator (VCO). Positive pulses from the phase detector drive the PLL's VCO toward phase lock through increasing VCO frequency while negative pulses achieve lock by driving the PLL's VCO frequency down.

Upon a person touching the external lockset, the magnitude of the change in oscillator 14 frequency is too large for the PLL to accommodate with a single short feedback pulse and the output of the PLL's phase detector remains "saturated" in a low (negative) state for several oscillator periods. A sustained high or low state to the input of monostable multivibrator 20 permits this timer to complete a timing cycle that theretofore was continually restarted before completion, with the edge of each positive going pulse from the PLL's phase detector. Upon full completion of a timing cycle, the NOT Q output of monostable multivibrator 20 provides a positive going pulse to the clock input of D-type flip flop 21. If the PLL's phase detector output is still low when the monostable multivibrator completes its timing cycle then the Q output of D-type flip flop is clocked from high to low. This negative going transition at the Q output of flip flop 20 reliably signals human contact with the lockset which is further qualified as discussed below.

To obtain automatic arming or enabling of the alarm, it's necessary to distinguish between contact associated with normally locking the door from contact associated with tampering. This is accomplished as described below: When the lockset is transitioned from its unlocked state to its locked state, the FET output of RF detector circuit 15 makes a transition from low to high. This transition leaves D-type flip flop 23 in its low or cleared state and ensures that the next positive going pulse at the clock input will, through the connection of the D input to supply, cause the Q output of the flip flop to go high. Because flip flop 23 can only be returned to its cleared state by reopening the lockset's bolt, only a single positive going output pulse is possible after each lockset closure.

Assuming, then, that the lockset is being locked, the following sequence of events will follow on detection of contact with the lockset as the bolt is engaged. First, D-type flip flop 21, as discussed above, will transition its Q output from high to low. This in turn will cause the Q output of set-reset (S/R) latch 24 to go high. At the same time, the FET output of RF detector 15 is also high by virtue of the bolt being in the closed or locked position. Both high signals serve as inputs to gate 25, causing its output to go low and in turn enabling binary counter/oscillator 26 to start. After a short delay of approximately 10 seconds, the eighth stage of counter 25 transitions from low to high and sends a positive going pulse to the clock input of flip flop 23, causing a positive going transition on its Q output. This positive going transition triggers monostable multivibrator 27, causing it to produce a timed pulse approximately ¼ second long which is positive going on the Q output and negative going on the NOT Q output. The pulse on the Q output serves to "chirp" an audible alarm indicating the system is armed. The pulse on the NOT Q output serves to set flip flop 21 Q output to its high state and S/R flip flop 24 to its reset state and thereby to cause the output of gate 25 to reset and halt counter oscillator 26. In this condition the system is armed and will announce any tampering detected with an alarm signal commencing approximately ten seconds after any contact not first culminated in successful bolt retraction. This alarm signal will be maintained until either 10 seconds after the lockset is opened and reclosed, or upon automatic shutoff after sufficient time to overflow counter/oscillator 26 and trigger timer 27 on the negative going transition of the final counter stage.

If the bolt is withdrawn from the bolt recess before completion of the approximately 10 second delay, no alarm will be announced and the alarm system will be disabled by virtue of the low logic signal from the FET output of RF detector 15. It should be noted that simple removal of the bolt from the bolt recess after the alarm sounds will not reset the alarm unless the bolt is first reinserted and the relatively short time delay is allowed to lapse, This serves to prevent silencing of the alarm upon destruction of the lockset.

Signaling lines 28 and 29 provide for connection to cooperative external components to signal respectively whether the lockset tampering detection device is in its alarmed state or not and whether it is in its armed state or not.

Many modifications and variations of the present invention are possible in light of the above teachings. It is therefore to be understood that within the scope of the appended claims the invention may be practiced otherwise than specifically described.

The invention claimed is:

1. A lockset tampering detection device which comprises:

sensing circuitry, operatively coupled to said lockset, responsive to signals indicative of tampering directed at defeating said lockset's locking means and means to determine if the lockset is in its open or locked state and means to signal a tampering alarm when said sensing circuitry detects said tampering directed at defeating said lockset after said lockset is transitioned from its unlocked state to its locked state, wherein the operative connection between said lockset tampering sensing circuitry and said lockset is achieved through circuitry's coupling to the lockset through its bolt by electrical, acoustic, magnetic, optical or other like means serving to signal tampering with the lock, through the bolt, to said sensing circuitry, wherein said sensing circuitry monitors qualified changes in capacitance between said lockset and a reference conductor as indicative of tampering.

2. The lockset tampering detection device of claim 1 wherein slow changes in capacitance, not indicative of tampering, are ignored.

3. The method of arming, or disarming a lockset tampering detection device having, sensing circuitry, operatively coupled to said lockset, responsive to signals indicative of tampering directed at defeating said lockset's locking means, means to signal if the lockset is in its open or locked state and means to signal a tampering alarm when said sensing circuitry detects tampering after said lockset is transitioned from its unlocked state to its locked state, comprising the steps of:

arming the lockset tampering detection device after the lockset is transitioned from its unlocked to its locked state and disarming the lockset tampering detection device after the lockset is transitioned from its locked state to its unlocked state wherein said arming steps further comprise the sub-steps of:

providing alarm inhibition for a sufficient time to allow normal, authorized means for transitioning the lockset from its locked to its unlocked state and providing a sustained tampering alarm when said inhibition time expires without locketset transition to its unlocked state with said sustained tampering alarm then made resetable only by first unlocking and relocking said lockset.

4. The method of claim 3 further comprising the steps of:

automatically resetting and rearming a lockset tampering alarm after a first, relatively long time limit and automatically resetting and rearming a lockset tampering alarm after a relatively short time limit when first preceded by said unlocking and relocking sequence and ensuring that said sustained tampering alarm is not precluded or terminated by forcibly overcoming the lockset's conventional mechanical locking function.

5. A lockset tampering detection device which comprises:

sensing circuitry operatively coupled to said lockset responsive to signals indicative of tampering directed at defeating said lockset's locking means and means to determine if the lockset is in its open or locked state and means to signal a tampering alarm when said sensing circuitry detects said tampering directed at defeating said lockset after said lockset is transitioned from its unlocked state to its locked state further comprising means to send a signal to a conventional multizone security system, said signal serving to communicate the status of said lockset such that the state of lockset tampering detection device may be determined to be:

disarmed or armed or in alarm and further comprising:

a conventional multi-zone security system through which lockset tampering alarms may be announced and a protected area, comprised of one or more zones, each secured by one or more lockset tampering detection devices and conventional means for the concurrent or rapid sequential determination of the state of each of the lockset tampering detection devices used to secure said protected area.

6. The lockset tampering detection device of claim 5 further comprising:

means to arm said conventional multi-zone security system when all of said lockset tampering detection devices in said protected area are determined to be in their armed state and means to selectively arm specific zones of said multi-zone security system when all the lockset tampering detection devices within said zones are determined to he in their armed state.

7. The lockset tampering detection device of claim 5 further comprising:

means to disarm said conventional multi-zone security system when any of said lockset tampering detection devices in said protected area are determined to be in their disarmed state and means to selectively disarm specific zones of said multi-zone security system when any lockset tampering detection devices within said zones are determined to be in their disarmed state.

8. The lockset tampering detection device of claim 5 further comprising:

means to alarm said conventional multi-zone security system when any of said lockset tampering detection devices in said protected area are determined to be in their alarmed state and means to selectively alarm specific zones of said multi-zone security system when any lockset tampering detection devices within said zones are determined to be in their alarmed state.

9. The lockset tampering detection device of claim 5 further comprising:

means to disable an inadvertent alarm of said multi-zone security system when the lockset tampering detection device that originated the alarm is reset through the sequential unlocking and relocking of the lockset monitored by said lockset tampering detection device.

10. The lockset tampering detection device of claim 5 further comprising:

means to selectively arm only the perimeter and not the area components of said conventional multizone security system when all of said lockset tampering detection devices in said protected area are determined to be in their armed state and when an authorized person is detected within the area secured by the lockset tampering detection devices and means to selectively arm only the perimeter and not the area components of one or more specific zones of said conventional multizone security system when all of said lockset tampering detection devices in said specific zones are determined to be in their armed state and an authorized person is detected within the zone secured by the lockset tampering detection devices.

11. The lockset tampering detection device of claim 10 further comprising means to:

automatically enable area components of said conventional multi-zone security system, upon detection of the departure of authorized occupants as signaled by the disarming and rearming of said lockset tampering detection device without alarm, followed by a suitable interval of the area components of said conventional multi-zone security system not detecting the presence of individuals in said protected area.

* * * * *